US011370143B2

(12) United States Patent
Cao et al.

(10) Patent No.: US 11,370,143 B2
(45) Date of Patent: Jun. 28, 2022

(54) CHAIN SAW

(71) Applicant: Globe (Jiangsu) Co., Ltd, Jiangsu (CN)

(72) Inventors: Yuexun Cao, Jiangsu (CN); Lingao Zhang, Jiangsu (CN); Tao Wang, Jiangsu (CN)

(73) Assignee: Globe (Jiangsu) Co., Ltd, Changzhou (CN)

( * ) Notice: Subject to any disclaimer, the term of this patent is extended or adjusted under 35 U.S.C. 154(b) by 30 days.

(21) Appl. No.: 17/106,128

(22) Filed: Nov. 29, 2020

(65) Prior Publication Data

US 2021/0162622 A1 Jun. 3, 2021

(30) Foreign Application Priority Data

Nov. 29, 2019 (CN) ..... 201911197581.1

(51) Int. Cl.
*B27B 17/14* (2006.01)
*B27B 17/02* (2006.01)
*B27B 17/08* (2006.01)

(52) U.S. Cl.
CPC ..... *B27B 17/14* (2013.01); *B27B 17/02* (2013.01); *B27B 17/08* (2013.01)

(58) Field of Classification Search
CPC ..... B27B 17/02; B27B 17/14; B27B 17/08; B27B 17/00
See application file for complete search history.

(56) References Cited

U.S. PATENT DOCUMENTS

2017/0043421 A1 2/2017 Nie et al.
2018/0281225 A1 10/2018 Gerstenberger et al.
2019/0366580 A1* 12/2019 Lu ..... B27B 17/02

FOREIGN PATENT DOCUMENTS

CN 101670596 A 3/2010
CN 106238820 A 12/2016
CN 207534978 U 6/2018
CN 110640843 A * 1/2020 ..... B27B 17/0083
EP 1764197 A2 * 3/2007 ..... B27B 17/14
EP 3808520 A2 * 4/2021 ..... B27B 17/02
WO WO-2004103657 A1 * 12/2004 ..... B27B 17/14

OTHER PUBLICATIONS

Search Report of Counterpart European Patent Application No. 20210435.2 dated Apr. 15, 2021.

* cited by examiner

*Primary Examiner* — Jennifer S Matthews

(57) ABSTRACT

The present invention provides a chain saw, which includes a housing, a driving assembly mounted on the housing, a guide plate extending outward from the housing, a chain arranged on the guide plate and driven by the driving assembly, and a tension assembly for tightening the chain. The tension assembly includes an operating member and a driving member driven by the operating member, the driving member cooperates with the guide plate, and when a driving force is applied to the operating member, the driving member is driven and the guide plate is moved to tension the chain, and after the chain is tensioned, if the driving force is continuously applied to the operating member, the operating member disengages with the driving member, and the operating member continues to move to compress the guide plate.

14 Claims, 8 Drawing Sheets

CHAIN SAW

CROSS-REFERENCE TO RELATED INVENTIONS

This invention claims the priority of CN invention Serial No. 201911197581.1, filed on Nov. 29, 2019, the disclosures of which are hereby incorporated by reference in their entirety.

TECHNICAL FIELD

The invention relates to a chain saw, and in particular to a chain saw with a chain tension assembly.

BACKGROUND ART

An electric chain saw having a saw chain driven by an electric motor to rotate at a high speed is known as a common garden tool for cutting wood or branches. If the chain is not properly tensioned, it may jump off the guiding plate in operation and injure the operator. If the chain is subjected to high mechanical stresses, the chain may experience high temperature failure due to excessive friction with the guiding plate and this also increases the risks of breakage. Moreover, the chain will be worn out over time, and the length of the chain will gradually increase after a period of use, leading to a reduced mechanical stress on the chain.

In order to use the chain saw safely and efficiently, the tension of the chain must be maintained properly at all times, so it is necessary to provide chain saw with a chain tension device. In one conventional arrangement, a tensioning assembly including an adjusting screw and a clamping nut is used to tension the chain, but it requires the operator to carry special tools to perform the tightening operation, which causes inconvenience. In another arrangement, a knob is used to drive a series of adjustment components to tension the chain, the operator can rotate the knob by hand and no special tool is required. However, the arrangements described above have significant disadvantages. Because the adjustment operation of the tension of the chain mainly depends on the experience of the operator, and it is difficult to control the mechanical stress exerted on the chain. Additionally, tensioning the chain and fixing the guiding plate are finished by two separate operation steps. If the adjustments of the tension are not in place, repeating steps are needed in order, which causes inconvenient in the operation procedure.

In view of this, it is necessary to improve the existing chain tension assembly in order to solve the above problems.

SUMMARY OF INVENTION

The object of the present invention is to provide a chain saw comprising a chain tension assembly, which can realize the tension of the chain and the fastening of the guide plate with a convenient operation by the operator. The chain tension assembly has a simple structure, and can reduce production and use costs.

To achieve the above object, the present invention provides a chain saw, comprising: a housing, a driving assembly mounted on the housing, a guide plate extending outward from the housing, a chain arranged on the guide plate and driven by the driving assembly, and a tension assembly for tightening the chain, wherein the tension assembly includes an operating member and a driving member driven by the operating member, the driving member cooperates with the guide plate, and when a driving force is applied to the operating member, the driving member is driven and the guide plate is moved to tension the chain, and after the chain is tensioned, if the driving force is continuously applied to the operating member, the operating member disengages with the driving member, and the operating member continues to move to compress the guide plate.

As a further improvement of the present invention, the tension assembly comprises a pin mounted on the operating member and cooperated with the driving member, and the operating member drives the driving member to move through the pin.

As a further improvement of the present invention, the tension assembly comprises an elastic member elastically abutting between the pin and the operating member, and the elastic member provides an engagement between the pin and the driving member.

As a further improvement of the present invention, the operating member comprises a receiving groove for receiving the elastic member and the pin, the pin is partially received in the receiving groove, and the portion of the pin extending outside the receiving groove cooperates with the driving member.

As a further improvement of the present invention, the tension assembly comprises a bracket, and wherein the bracket and the operating member jointly fix the elastic member and the pin in the receiving groove.

As a further improvement of the present invention, wherein the driving member comprises grooves that cooperate with the pins, and the number of the grooves is twice or more than the number of the pins.

As a further improvement of the present invention, the chain saw further comprises a tension device cooperated with the driving member and is driven by the driving member to tension the chain, and the tension device includes a tension block, a guide shaft, a return spring and a pressing block, the tension block and the return spring are arranged on the guide shaft, and the extending direction of the guide shaft is parallel to the moving direction of the guide plate.

As a further improvement of the present invention, the tension block comprises two or more protrusions, and the driving member comprises an arc-shaped track cooperating with the protrusion to drive the tension device.

As a further improvement of the present invention, the tension block comprises two protrusions, and a through hole and a slot hole are arranged on the guide plate, one of the protrusions cooperates with the through hole and the other protrusion cooperates with the slot hole.

As a further improvement of the present invention, the slot hole extends along the longitudinal direction of the guide plate and is located at the middle position of the guide plate in the vertical direction, and wherein two through holes are arranged on the guide plate and symmetrically distributed on both sides of the slot hole in the vertical direction.

As a further improvement of the present invention, the housing comprises a mounting member for mounting the tension device and a screw passing through the mounting member.

As a further improvement of the present invention, the tension block and the return spring are sleeved on the guide shaft, and the guide shaft is restricted in the groove of the mounting member by the pressing block.

As a further improvement of the present invention, the chain saw further comprises a side cover cooperating with the housing for holding the guide plate, and the side cover is assembled to the housing via the screw.

As a further improvement of the present invention, a threaded post is arranged at the middle position of the operating member, and the threaded post has a hollow structure with internal threads mating with the screw.

As a further improvement of the present invention, the elastic member is configured as a compression spring, and the pin is sleeved on the compression spring.

The beneficial effect of the present invention is that the chain saw of the present invention utilizes the mutual cooperation between the operating member and the driving member, so that when a driving force is applied to the operating member, the driving member can be used to drive the guide plate to move and tension the chain. After the chain is tensioned, the driving force is continued to be applied to the operating member. At this time, the operating member is released from the driving member, and the operating member continues to move to compress the guide plate. Compared with the prior art, the chain saw of the present invention is not only convenient for use, but also has a simple structure and can reduce production and use costs.

DESCRIPTION OF EMBODIMENT

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein.

Figure 1:
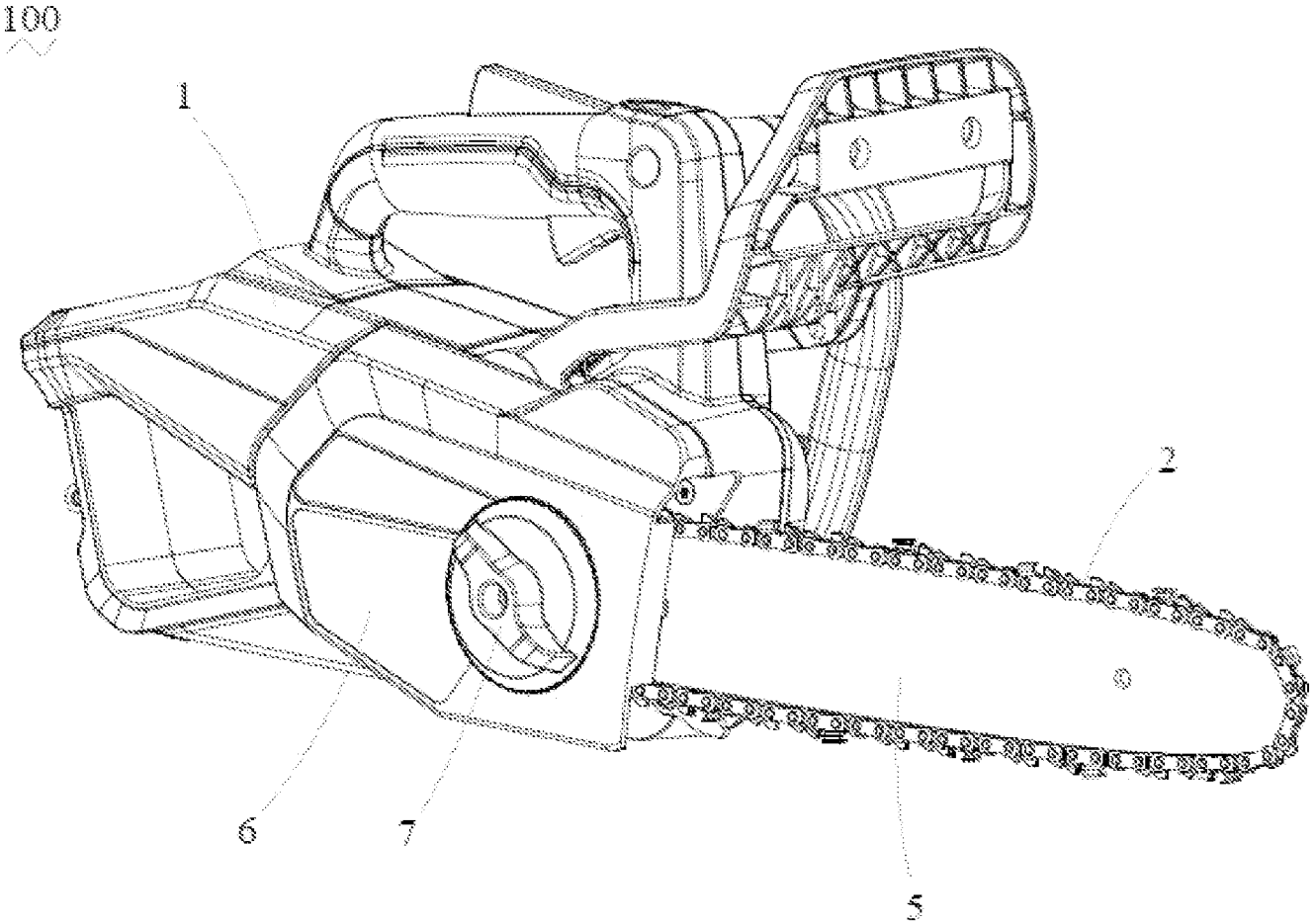
FIG. 1 is a perspective view of the chain saw according to the present invention.
Figure 2:
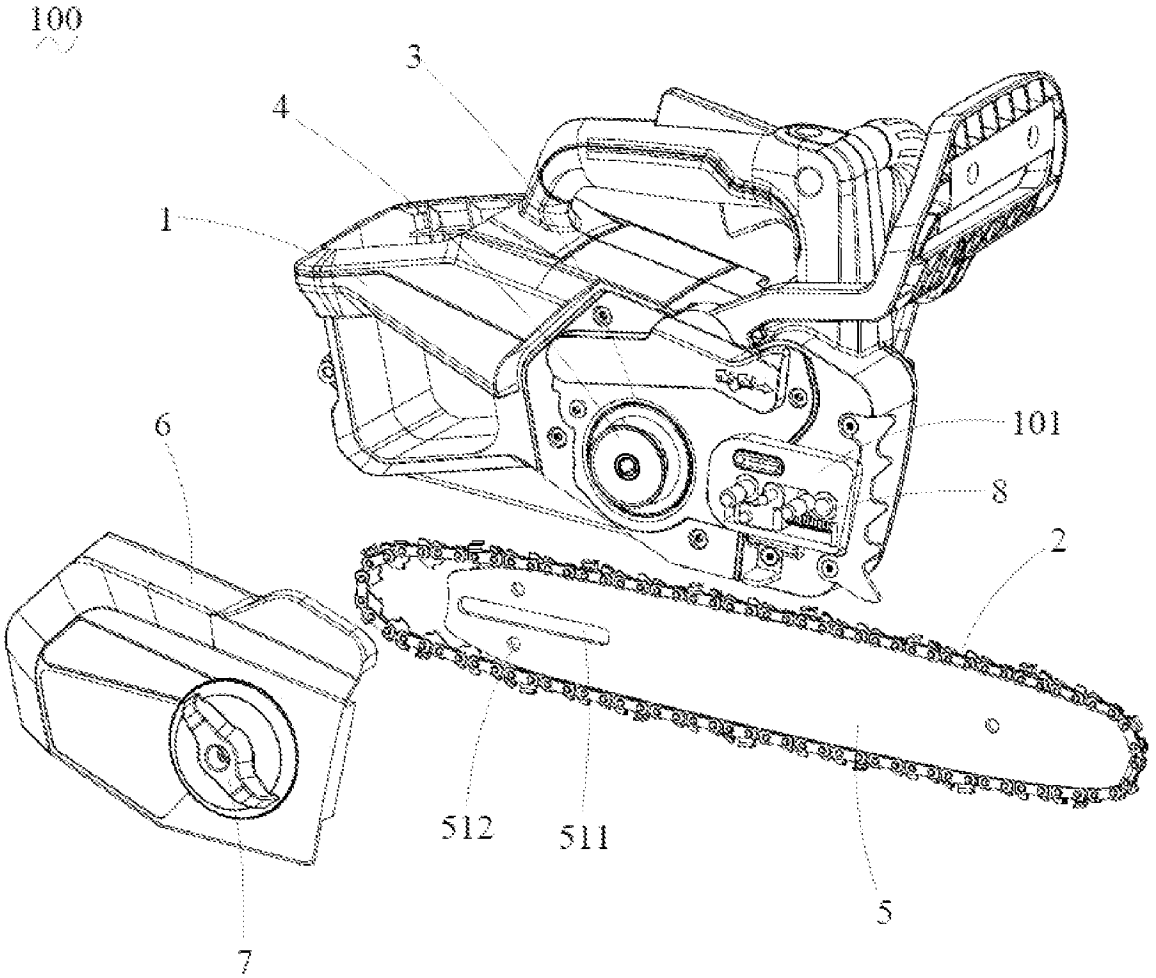
FIG. 2 is a partially exploded view of the chain saw shown in FIG. 1.
Figure 3:
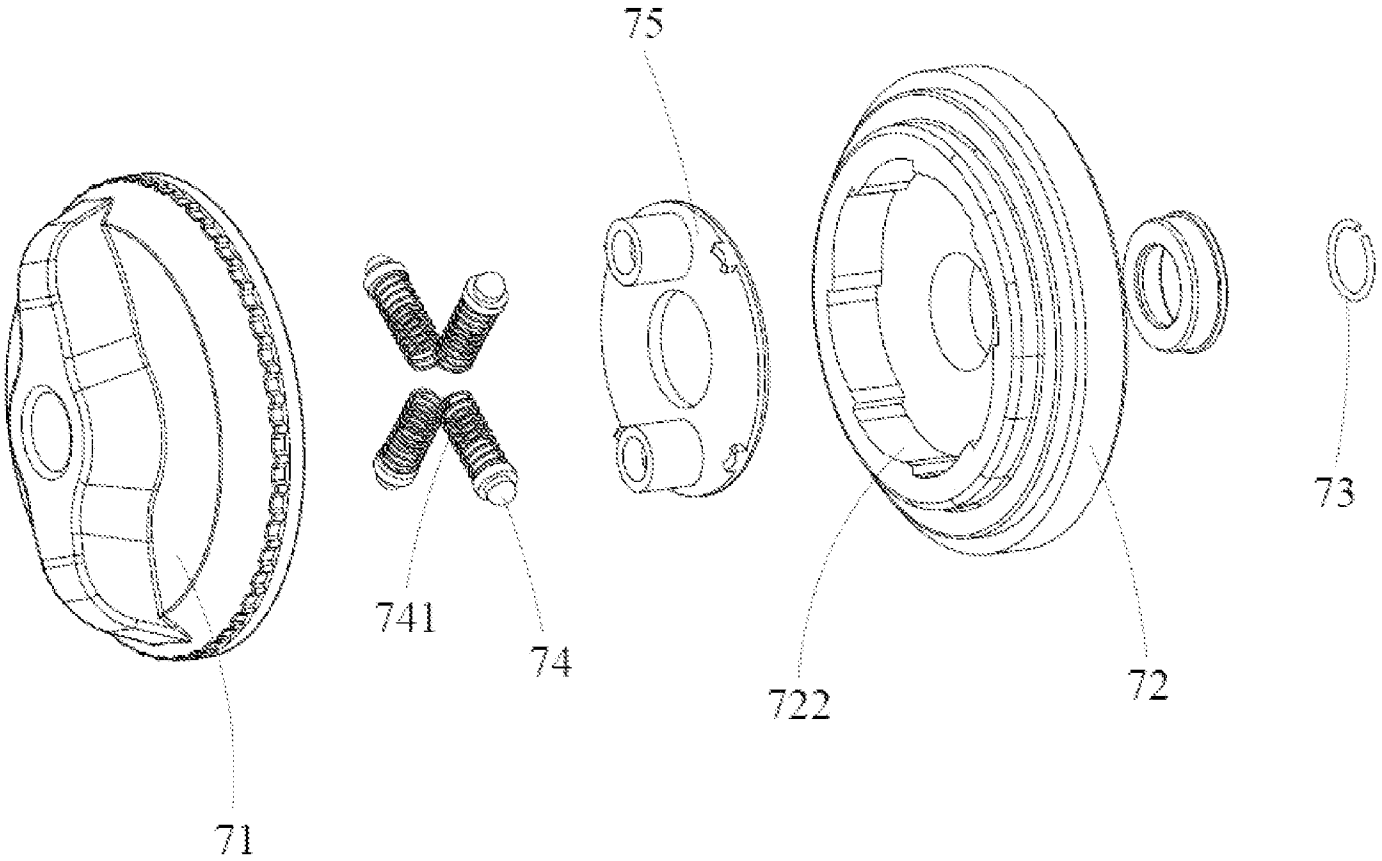
FIG. 3 is an exploded view of the tension assembly in FIG. 2.
Figure 4:
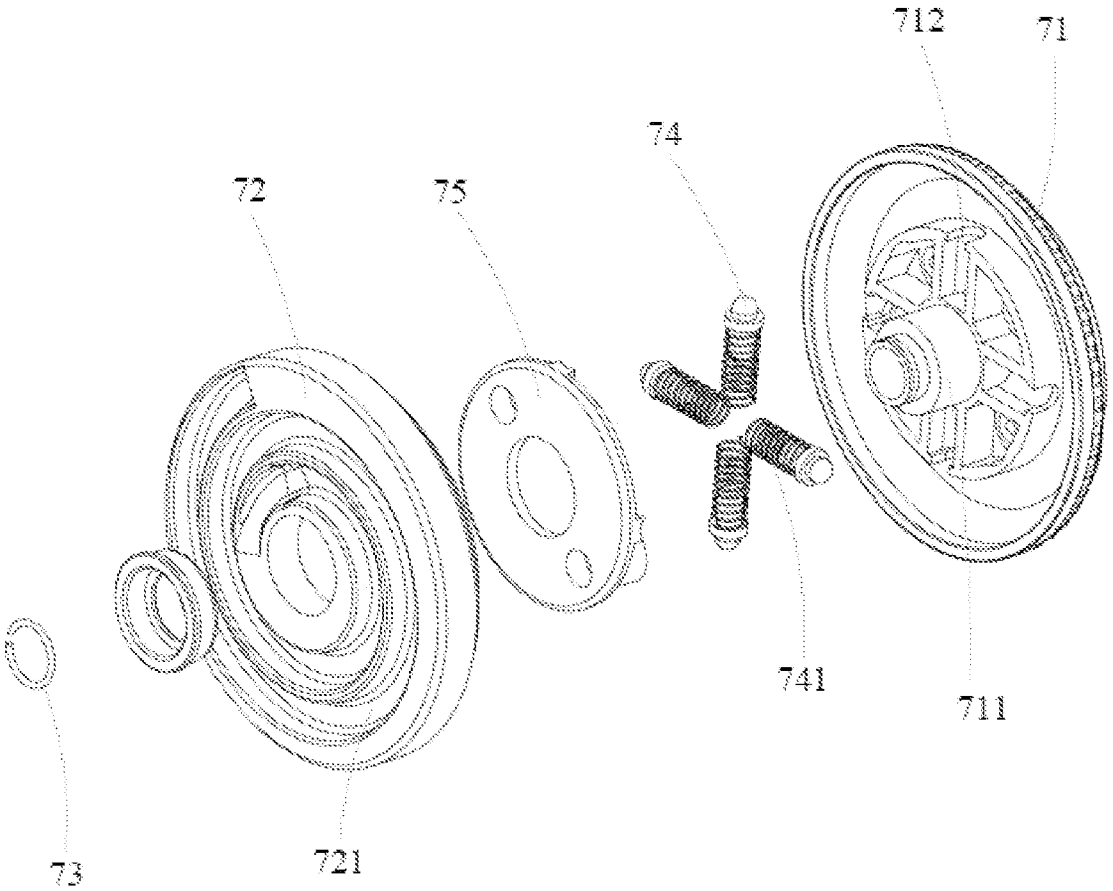
FIG. 4 is another perspective exploded view of the tension assembly shown in FIG. 3.
Figure 5:
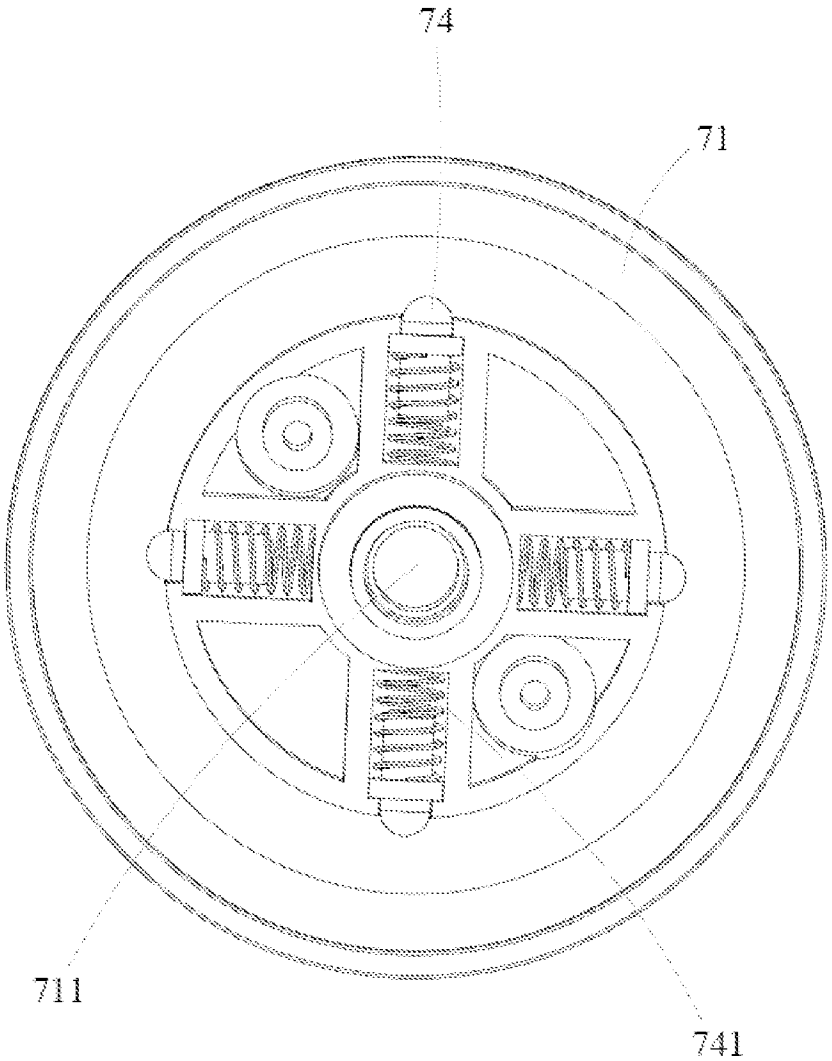
FIG. 5 is a side view when the pin and the elastic member in FIG. 4 are accommodated in a knob.
Figure 6:
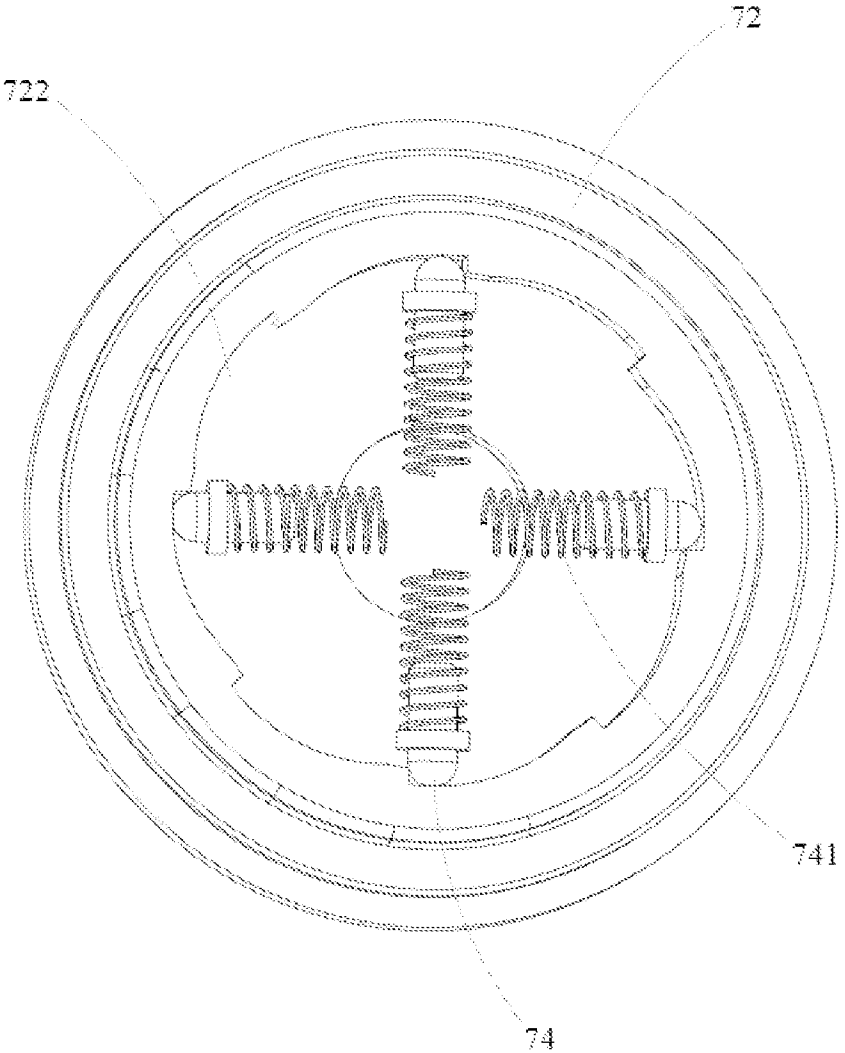
FIG. 6 is a perspective view when the pin and the elastic member in FIG. 3 cooperate with the driving member.

As shown in FIG. 1 and FIG. 2, the present invention discloses a chain saw 100 including a housing 1, a driving assembly 3 mounted on the housing 1, a chain wheel 4 driven by the driving assembly 3 and supported on the housing 1, a guide plate 5 extending outward from the housing 1, a side cover 6 cooperating with the housing 1 for holding the guide plate 5, a chain 2 disposed on the guide plate 5 and driven by the driving assembly 3 for reciprocating motion, and a tension assembly 7 for tensioning the chain 2. Of course, the chain saw 100 also includes some other structures mounted on the housing 1, such as a rear handle, a front handle, a protective plate, a power supply unit, a trigger, etc. These structures can be designed with reference to the prior art and will not described in detail here.

The chain wheel 4 is used to drive the chain 2 to move. In other words, one end of the chain 2 is set on the chain wheel 4 and the other end is set on the guide plate 5 so that when the driving assembly 3 drives the chain wheel 4 to rotate, the chain 2 is driven to reciprocate and the guide plate 5 is moved back and forth. The side cover 6 covers the outside of the guide plate 5 to prevent the guide plate 5 from shaking in a direction perpendicular to the guide plate 5 during the movement. In this embodiment, the driving assembly 3 is a motor, but it should not be limited thereto.

One end of the guide plate 5 is supported by the housing 1, and the other end extends longitudinally outward from the housing 1 to support and guide the chain 2. The end of the guide plate 5 supported on the housing 1 is provided with a slot hole 511 and a through hole 512. The slot hole 511 extends along the longitudinal direction of the guide plate 5 and is located approximately at the middle position of the guide plate 5 in the vertical direction. Preferably, there are two through holes 512, and they are symmetrically distributed on both sides of the slot hole 511 in the vertical direction.

It should be noted that the slot hole 511 is preferably an elongated round hole, but it is not limited thereto. The slot hole 511 can be configured as other shapes as long as the technical solution of the present invention can be realized, for example, a rectangular hole or a parallelogram hole. The shape of the through hole 512 is preferably circular, but it is not limited thereto. The through hole 512 can also be other shapes as long as the technical solution of the present invention can be realized, for example, a quadrilateral hole, a pentagonal hole, a hexagonal hole, a plum hole or a cross hole. The shapes of the two through holes 512 may be the same or different.

As shown in FIG. 3 to FIG. 6 in combination with FIG. 2, the tension assembly 7 can perform both tensioning and locking functions of the chain 2. The tension assembly 7 includes an operating member 71, a driving member 72 driven by the operating member 71, at least one pin 74 mounted on the operating member 71 and cooperating with the driving member 72, and an elastic member 741 set between the pin 74 and the operating member 71. When the user applies a driving force to the operating member 71, the driving member 72 is driven to move by the pin 74 and the elastic member 741, and the guide plate 5 is driven to move to tension the chain 2.

The elastic member 741 is used to provide an elastic engagement force between the pin 74 and the driving member 72, and an elastic engagement force between the pin 74 and the operating member 71. The operating member 71 comprises a receiving groove 712 for receiving the elastic member 741 and the pin 74. The pin 74 is partially received in the receiving groove 712, and the portion of the pin 74 extending radially out of the receiving portion 712 is engaged with the driving member 72. The elastic member 741 is completely received in the receiving groove 712. One end of the elastic member 741 abuts against the operating member 71 and the other end abuts against the pin 74 to provide a force between the pin 74 and the operating member 71.

The tension assembly 7 further includes a bracket 75. The bracket 75 and the operating member 71 together fix the elastic member 741 and the pin 74 in the receiving groove 712. The driving member 72 comprises a groove 722 that cooperates with the pins 74, and the number of the groove 722 is twice or more than the number of the pins 74. A threaded post 711 is arranged at the middle position of the operating member 71, and four receiving grooves 712 are evenly distributed on the outside of the threaded post 711 so as to receive four elastic members 741 and four pins 74. A retaining ring 73 is mounted on the threaded post 711.

In this embodiment, the tension assembly 7 is mounted on the side cover 6, and the operating member 71 is a knob that is rotatably operated. In this embodiment, the driving member 72 is a rotating disk that can be rotatable driven by the knob 71. One side of the rotating disk 72 comprises an arc-shaped track 721. The elastic member 741 is a compression spring, and the pin 74 is sleeved on the compression spring 741. The number of the pins 74 and the compression springs 741 is four, and they are evenly distributed in the circumferential direction of the knob 71 and abut against the threaded post 711 respectively. The bracket 75 is fixed to the knob 71 by a bolt (not shown) to fix the pin 74 and the compression spring 741 in the receiving groove 712.

Figure 7:
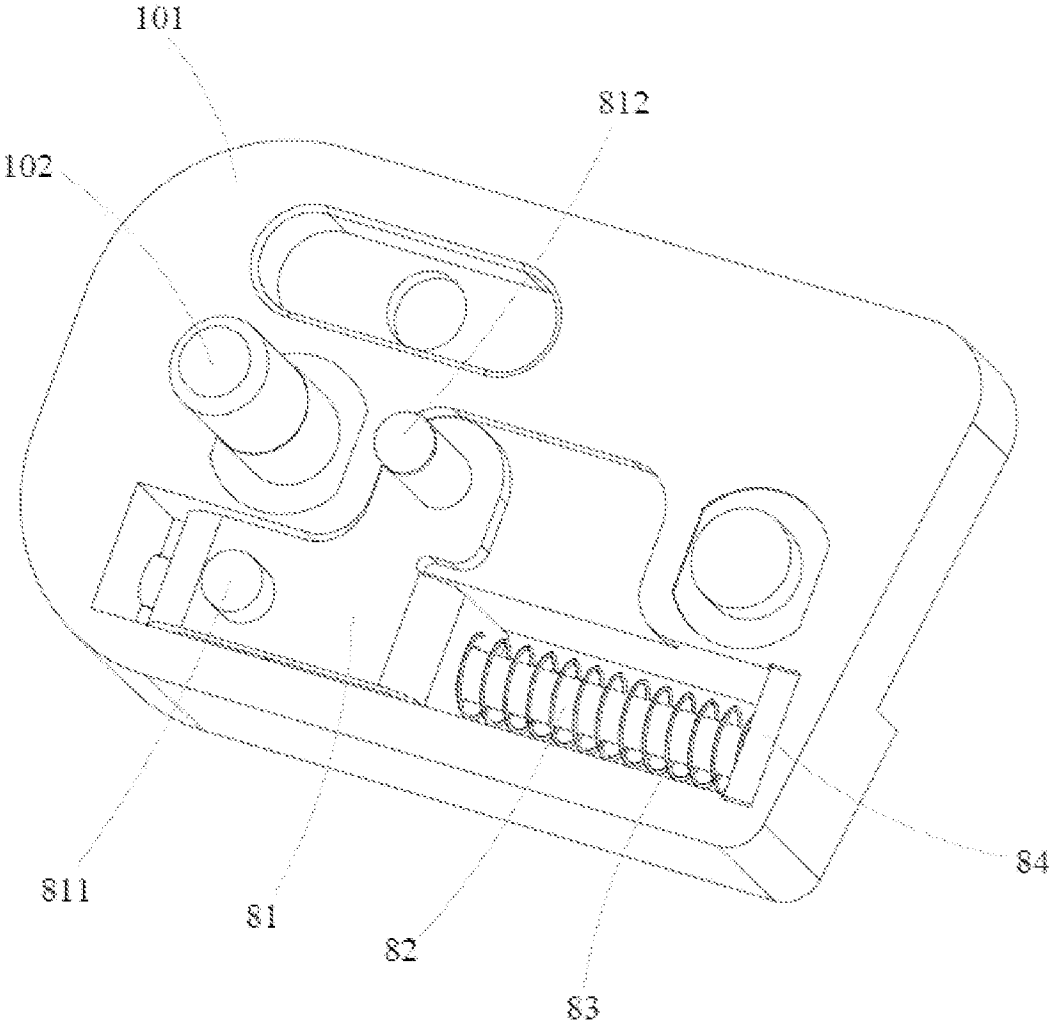
FIG. 7 is a perspective view of the tension device installed on the mounting member shown in FIG. 2.
Figure 8:
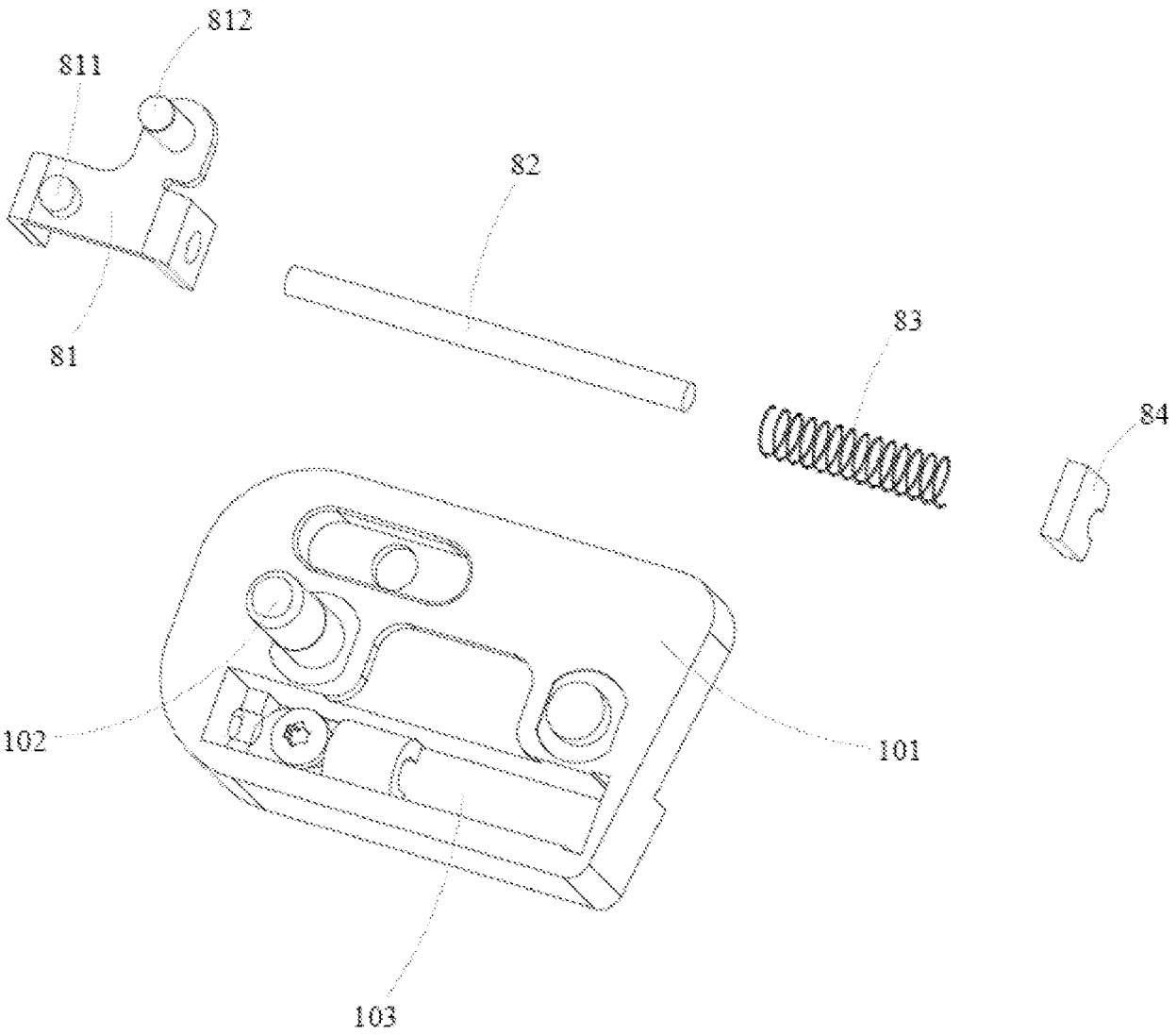
FIG. 8 is an exploded view of FIG. 7.

As shown in FIG. 7 and FIG. 8 in combination with FIG. 2, the chain saw 100 further includes a tension device 8 that engages with the driving member 72 and can be driven by the driving member 72 to tension the chain 2. The tension device 8 includes a tension block 81, a guide shaft 82, a return spring 83, and a pressing block 84. The tension block 81 and the return spring 83 are disposed on the guide shaft 82, and the extending direction of the guide shaft 82 is parallel to the moving direction of the guide plate 5. The tension block 81 comprises two or more protrusions. In this embodiment, there are two protrusions, a first protrusion 811 and a second protrusion 812. The first protrusion 811 is engaged with the through hole 512 of the guide plate 5, the second protrusion 812 is engaged with the slot hole 511 of the guide plate 5, and the arc-shaped track 721 of the rotating disk 72 is engaged with the second protrusions 812 to drive the tension device 8.

The housing 1 comprises a mounting member 101 for mounting the tension device 8 and a screw 102 passing through the mounting member 101. The tension assembly 7 is sleeved on the screw 102 to rotatably cooperate with the screw 102. Specifically, a groove 103 is recessed on the mounting member 101, the tension block 81 and the return spring 83 are sleeved on the guide shaft 82, and the guide shaft 82 is restricted in the groove 103 of the mounting member 101 by the pressing block 84. The threaded post 711 has a hollow structure with internal threads, and the screw 102 passes through the slot hole 511 in the guide plate 5 during assembly, so that the internal thread of the threaded post 711 and the screw 102 are rotatably matched. The side cover 6 is assembled to the housing 1 via the screw 102, so that when the knob 71 is rotated, the guide plate 5 can be moved by the screw 102 and the first protrusion 811, thereby the chain 2 is tightened, and the guide plate 5 can be locked.

When the guide plate 5 and the chain 2 are assembled, the guide plate 5 is assembled to the mounting member 101 along the longitudinal direction of the housing 1. The screw 102 and the second protrusion 812 pass through the slot hole 511 of the guide plate 5, and the first protrusion 811 of the guide plate 5 passes through the through hole 512. Then, the chain 2 is assembled to the chain wheel 4 and the guide plate 5.

Because the tension assembly 7 is rotatably connected to the screw 102, the arc-shaped track 721 drives the second protrusion 812 to move along the slot hole 511 by rotating the knob 71, thereby driving the guide plate 5 to move, and thus tensioning the chain 2. After the chain 2 is tensioned, if the knob 71 is further rotated, the movement of the tension device 8 is subject to resistance. When the resistance reaches a set value, the rotating disk 72 does not continue to rotate, and the rotating disk 72 compresses the elastic member 741 through the pin 74 until the rotating disk 72 is disengaged from the knob 71. That is, the rotational force applied to the pin 74 by the knob 71 is greater than the resistance exerted by the rotating disk 72 to the pin 74. At this time, the pin 74 moves from one groove 722 to the other groove 722, and a clicking sound is generated. The knob 71 is further rotated, the threaded post 711 continue to rotate and engage with the screw 102, and the side cover 6 is pressed against the mounting member 101 by the rotation of the knob 71, so that the purpose of pressing the guide plate 5 is achieved.

In summary, the chain saw 100 of the present invention utilizes the cooperation between the operating member 71 and the driving member 72, so that when a driving force is applied by the operating member 71, the guide plate 5 can be driven to move by the driving member 72 to tension the chain 2. And after the chain 2 is tensioned, if the driving force is continued to be applied to the operating member 71, the operating member 71 is disengaged from the driving member 72, and the locking of the guide plate 5 can be achieved. Compared with the prior art, the chain saw 100 of the present invention is not only convenient for users to use, but also has a simple structure and can reduce production and use costs.

The above description is only an embodiment of the present invention, and thus does not limit the scope of the patent of the present invention. Any equivalent structure or equivalent process transformation made by using the description and drawings of the present invention, or directly or indirectly applied to other related technologies, all should fall in the scope of the present invention.

What is claimed is:

1. A chain saw, comprising:

a housing;

a driving assembly mounted on the housing;

a guide plate extending outward from the housing;

a chain arranged on the guide plate and driven by the driving assembly; and a tension assembly for tightening the chain, wherein the tension assembly includes an operating member and a driving member driven by the operating member, the driving member cooperates with the guide plate, a driving force is applied to the operating member and the driving member is driven and the guide plate is moved to tension the chain, the driving force is configured for continuously rotating the operating member when the chain is tensioned to disengage the operating member from the driving member, and the operating member continues to move to compress the guide plate, and a tension device including a tension block, a guide shaft, a return spring and a pressing block, the tension device cooperates with the driving member and is driven by the driving member to tension the chain, and the tension block and the return spring are arranged on the guide shaft, and the guide shaft extends in a direction parallel to a moving direction of the guide plate.

2. The chain saw according to claim 1, wherein the tension assembly comprises a pin mounted on the operating member and cooperated with the driving member, and the operating member drives the driving member to move through the pin.

3. The chain saw according to claim 2, wherein the tension assembly comprises an elastic member elastically abutting between the pin and the operating member, and the elastic member provides an engagement between the pin and the driving member.

4. The chain saw according to claim 3, wherein the operating member comprises a receiving groove for receiving the elastic member and the pin, the pin is partially received in the receiving groove, and the portion of the pin extending outside the receiving groove cooperates with the driving member.

5. The chain saw according to claim 4, wherein the tension assembly comprises a bracket, and wherein the bracket and the operating member jointly fix the elastic member and the pin in the receiving groove.

6. The chain saw according to claim 2, wherein the driving member comprises grooves that cooperate with the pins, and a number of the grooves is twice or more than the number of the pins.

7. The chain saw according to claim 3, the elastic member is configured as a compression spring, and the pin is sleeved on the compression spring.

8. The chain saw according to claim 1, wherein the tension block comprises two or more protrusions, and the driving member comprises an arc-shaped track cooperating with the protrusion to drive the tension device.

9. The chain saw according to claim 8, wherein the tension block comprises two protrusions, and a through hole and a slot hole are arranged on the guide plate, one of the protrusions cooperates with the through hole and the other protrusion cooperates with the slot hole.

10. The chain saw according to claim 9, wherein the slot hole extends along the longitudinal direction of the guide plate and is located at a middle position of the guide plate in a vertical direction, and wherein two through holes are arranged on the guide plate and symmetrically distributed on both sides of the slot hole in the vertical direction.

11. The chain saw according to claim 1, wherein the housing comprises a mounting member for mounting the tension device and a screw passing through the mounting member.

12. The chain saw according to claim 11, wherein the tension block and the return spring are sleeved on the guide shaft, and the guide shaft is restricted in the groove of the mounting member by the pressing block.

13. The chain saw according to claim 11, wherein the chain saw further comprises a side cover cooperating with the housing for holding the guide plate, and the side cover is assembled to the housing via the screw.

14. The chain saw according to claim 11, wherein a threaded post is arranged at a middle position of the operating member, and the threaded post has a hollow structure with internal threads mating with a screw.

* * * * *